US006023245A

United States Patent [19]

Gomez et al.

[11] Patent Number: 6,023,245

[45] Date of Patent: Feb. 8, 2000

[54] MULTI-BAND, MULTIPLE PURPOSE ANTENNA PARTICULARLY USEFUL FOR OPERATION IN CELLULAR AND GLOBAL POSITIONING SYSTEM MODES

[75] Inventors: Francisco X. Gomez, Melrose Park; Joseph F. Mockus, North Riverside; Peng Gong, Addison, all of Ill.

[73] Assignee: Andrew Corporation, Addison, Ill.

[21] Appl. No.: 09/131,573

[22] Filed: Aug. 10, 1998

[51] Int. Cl.[7] ..... H01Q 21/00

[52] U.S. Cl. ..... 343/725; 343/700 MS; 343/713

[58] Field of Search ..... 343/725, 729, 343/700 MS, 702, 872, 713, 715, 705; H01Q 21/00

[56] References Cited

U.S. PATENT DOCUMENTS

| | | | |
|---|---|---|---|
| 3,139,620 | 6/1964 | Leidy et al. | 343/730 |
| 4,030,100 | 6/1977 | Perrotti | 343/709 |
| 4,329,690 | 5/1982 | Parker | 343/709 |
| 4,644,361 | 2/1987 | Yokoyama | 343/700 MS |
| 5,043,736 | 8/1991 | Darnell et al. | 342/357 |
| 5,079,562 | 1/1992 | Yarsunas et al. | 343/715 |
| 5,300,936 | 4/1994 | Izadian | 343/700 MS |
| 5,402,134 | 3/1995 | Miller et al. | 343/742 |
| 5,418,537 | 5/1995 | Bird | 342/357 |
| 5,519,406 | 5/1996 | Tsukamoto et al. | 343/700 MS |
| 5,523,761 | 6/1996 | Gildea | 342/357 |
| 5,604,506 | 2/1997 | Rodal | 343/791 |
| 5,610,620 | 3/1997 | Stites et al. | 343/725 |
| 5,691,726 | 11/1997 | Nichols et al. | 343/700 MS |

*Primary Examiner*—Hoanganh Le
*Attorney, Agent, or Firm*—Vedder, Price, Kaufman & Kammholz

[57] ABSTRACT

A multiple use, multi-band antenna for mobile wireless communication and global positioning has includes a elongated cellular radiating element and a GPS radiating element supported atop the cellular radiating element. The cellular radiating element has a continuous body portion of varying diameter that forms a flared upper portion which supports a global positioning system amplifier mounted thereon. The GPS amplifier unit takes the form of a GPS patch radiator disposed atop a low noise amplifier. The cellular and GPS radiating elements are fed by respective first and second feedlines. The stacking of the GPS amplifier unit on the cellular radiating element provides a top loading effect for the cellular radiating element that enables it to resonate across all pertinent cellular frequencies.

23 Claims, 8 Drawing Sheets

MULTI-BAND, MULTIPLE PURPOSE ANTENNA PARTICULARLY USEFUL FOR OPERATION IN CELLULAR AND GLOBAL POSITIONING SYSTEM MODES

BACKGROUND OF THE INVENTION

The present invention relates generally to antennas for use in wireless communication systems. More particularly, the present invention relates to multiple purpose antennas used in vehicles and crafts having both global positioning systems and cellular telephone systems.

The expansion of mobile and personal cellular telephone systems has been rapid and widespread during the last few years. Originally, cellular telephone systems were designed to provide communication services primarily to vehicles and thus replace mobile radio telecommunication systems. Advancements in technology and production have sufficiently decreased the costs of cellular service to the point at which cellular telephone service has now become affordable to a majority of the general population. Therefore, a "cellular" telephone system no longer strictly refers exclusively to cellular telephones, which originally were physically attached to and made a part of the vehicle. A cellular telephone system now also includes portable, personal telephones which may be carried in a pocket or a purse and which may be easily used inside or outside a vehicle or building.

Traditionally, wireless communication systems have included antennas that transmit and receive radio frequency ("RF") signals within the NAMPS band of frequencies in the United States or the GSM band of frequencies in Europe. Wireless communication systems which operate in the NAMPS or GSM frequency bands generally operate in a relatively low frequency band. The NAMPS bandwidth used for conventional cellular communication in the United States extends from about 824 MHz to about 894 MHz. The GSM bandwidth used for conventional cellular communication in Europe extends from about 872 MHz to about 960 MHz.

The wireless communications industry has recently broadened the scope of communication services by providing small, inexpensive, hand-held transceivers that transmit and receive voice and/or data communications, notwithstanding the geographic location of the user. These newer communication systems are also considered as cellular systems and operate within higher frequency bands than the NAMPS/GSM frequency bands and have generally been referred to as a personal communication network (PCN) and/or a personal communication system (PCS). The PCN and PCS-type systems are wireless communication systems which, for all intents and purposes, eliminate the need for separate telephone numbers for the home, office, pager, facsimile or car.

With the recent surge in the use of wireless communication devices, a need has grown to extend the capacity and to improve the communication quality and security of wireless communication systems. As such, several countries and communication providers have agreed upon international communication standards and set aside a portion of the ultra-high frequency microwave radio spectrum as frequency bands which are dedicated exclusively for PCN and PCS communication systems.

On a worldwide basis, the PCN, PCS and JTACS (used in Japan) frequency bands extend from about 1.4 GHz (1500 MHz) to about 2.4 GHz (2400 MHz). Within those bands, individual countries have set aside particular portions of it for their respective wireless communication systems. For example, Japan, which uses JTACS, has set aside from about 1.429 GHz (1429 MHz) to about 1.521 GHZ (1521 MHz), Europe, which uses PCN, has set aside from about 1.710 GHz (1710 MHz) to about 1.880 GHz (1880 MHz) and the United States, which uses PCS, has set aside from about 1.850 GHz (1850 MHz) to about 1.990 GHz (1990 MHz).

The bandwidths of the above different frequency bands represent approximately forty percent (40%), or only about 400 MHz, of the total possible bandwidth set aside for the higher frequency band wireless communication systems. The lowest frequency included within this bandwidth is almost two times higher than the standard frequency at which cellular telephone communication systems operate within the United States, namely 800 MHz, i.e., the NAMPS frequency band. Wireless communication systems operating in the PCN, PCS or JTACS frequency bands have improved communication quality and strengthened security over those systems which utilize the lower frequency bands.

An ever increasing number of regions now utilize the PCS (United States), PCN (Europe) or JTACS (Japan) frequency bands for wireless communications. In most of those regions, wireless telephone units must be able to operate in both the higher and lower frequency bands, i.e., in both the NAMPS and PCS frequency bands in the United States, and in both the GSM and the PCN frequency bands in Europe, so that a user of such units may selectively choose the frequency band of operation for the unit. Additionally, the units themselves may selectively choose their operating frequency band so that the chosen band matches the frequency of the electromagnetic signals received from a wireless telephone unit placing an incoming call to that particular unit.

In a different wireless application, electromagnetic signals are often used in tracking and global positioning systems. The NAVSTAR Global Positioning System (GPS) is a Department of Defense satellite navigation system that uses a constellation of GPS navigation satellites in a space segment (SS) to transmit GPS signals and data from which a GPS receiver may derive accurate position, velocity and time information with respect to the position of a person, vehicle or craft.

A GPS control segment on the ground tracks the SS satellite constellation, and uplinks to each GPS satellite ephemeral data regarding its orbital characteristics and satellite clock correction parameters to precisely synchronize the on-board satellite atomic clock with reference to GPS system time. Each GPS satellite continually transmits a navigation signal that provides navigation message data, including time of transmission, satellite clock correction parameters and ephemeral data.

The navigation signal is transmitted over two carrier frequencies in the L band (L1 at 1575.42 MHz and L2 at 1227.6 MHz). This navigation signal includes latitude, longitude, altitude and timing data for marine, aerial and mobile tracking information. Reception of this navigation signal permits a GPS receiver to identify and track its global position. This GPS technology provides tracking information for vehicles, crafts and even persons that carry GPS locating devices.

These GPS systems are now being incorporated in automobiles, trucks and to provide location and travel information to the operator. They are also used in other vehicles, such as farm tractors to indicate the exact position of the tractor (and any implements it tows) to the farmer. Similarly, the use of GPS systems is increasing in watercraft. In all these applications, the operator of the vehicle or craft may often utilize a cellular telephone. Presently, a separate antenna is needed for the GPS locator and for the cellular telephone. The use of two separate antennas for the cellular and GPS systems unduly complicates the exterior profile of the vehicle or craft.

It is therefore desirable to develop antennas that may transmit and receive electromagnetic signals in all of the above-identified frequency bands.

Previous multi-band antennas have been designed to transmit and receive electromagnetic signals in the AM/FM and the NAMPS cellular operating frequencies. These previous multi-band antennas are useful in that they minimize the number of radiating elements that are required to operate equipment in those frequency bands. However, their use has been limited to operation within those lower frequency bands due to their inherent narrow bandwidth. The use of multi-band antenna technology at operating frequencies higher than AM/FM and NAMPS has not yet been feasible. In particular, the multi-band frequency antennas have not yet been operable in the GSM (872–960 MHz), PCN (1710–1880 MHz), PCS (1850–1990 MHz) and JTACS (1429–1521 MHz) frequency bands. With the increasing popularity of other applications for wireless technology, such as GPS (1574–1576 MHz), it is desirable to create a single antenna that can provide tracking and voice/data communications simultaneously. A combined GPS/cellular solution for this purpose is the focus of this invention.

SUMMARY OF THE INVENTION

In light of the aforementioned shortcomings of the prior art antennas and the features of the present invention, it is a general object of the present invention to provide a new and improved multi-band antenna.

Another object of the present invention is to provide a multi-band antenna for mobile voice and data communications.

Still another object of the present invention is to provide a multi-band antenna for vehicular tracking and global positioning.

Yet another object of the present invention is to provide a multi-band antenna for operation with two different wireless systems, such as a cellular and a GPS system that is inexpensive to manufacture.

It is still another object of the present invention to provide a broadband cellular radiating element that has unity gain (0 dB) and a low voltage standing wave ratio (less than 1.5:1) between 806 MHz and 1990 MHz.

It is yet another object of the present invention to provide a single antenna that permits wireless communication within the NAMPS, GSM, PCN, PCS, JTACS and other 0 dB frequency bands.

It is still another object of the present invention to provide an antenna that covers the aforementioned frequency bands and provides for reception of GPS navigation signals.

Another object of the present invention is to provide a GPS amplifier unit that permits reception of GPS navigation signals and has a top loading effect on a cellular radiating element to broaden the bandwidth of that element.

Yet another object of the present invention is to provide a multi-band antenna that includes a quarter wavelength radiator and a GPS amplifier unit arranged in a stacked configuration so that the GPS radiation pattern is isolated from the cellular radiation pattern.

The present invention provides an antenna having a GPS unit that operates at frequencies of 1574 MHz to 1576 MHz and also having a broadband quarter wavelength radiating unit that provides for unity gain (0 dB) and a voltage standing wave ratio (VSWR) of less than 1.5:1 across the conventional cellular frequencies, ranging from 806 MHz to 1990 MHz.

This single multi-band antenna is incorporated in an antenna housing that may be mounted and remounted without modifications to the installation site or the unit itself.

As exemplified by the preferred embodiment, the antenna of present invention includes a broadband cellular radiator, preferably a quarter-wave radiating element that functions as a unity gain (0 dB) radiator across a wide range of cellular frequencies and that provides for a single robust design which will function in many cellular systems, including NAMPS, GSM, PCN, PCS and JTACS. The antenna further includes an active GPS amplifier unit that is stacked atop the broadband radiating element. The GPS unit includes a patch radiator and provides a top loading effect on the cellular radiating element which beneficially broadens the bandwidth of the cellular radiating element.

The cellular radiating element is flared at its top portion to support the GPS amplifier unit in that the GPS unit sits atop the cellular radiating element flared portion so that they cooperate to form a stacked configuration. In this stacked configuration, the GPS radiation pattern is isolated from the cellular radiation pattern. The GPS patch radiator has a directional radiation pattern that is directed vertically away from the antenna, while the cellular radiating element has an omni-directional pattern directed radially and horizontally from the antenna in a 360° pattern so that the cellular antenna radiation pattern does not interfere with the GPS antenna radiation pattern.

The antenna includes an exterior housing that serves to protect the electronics from the effects of the environment and the antenna is fed by first and second coaxial feedlines which respectively feed the cellular antenna and the GPS patch antenna. The housing acts as a radome, which introduces an effect on the radiating pattern. This effect may be optimized through proper material selection of the housing, which is preferably made of a polycarbonate or other engineering grade plastic. The housing, as described in the preferred embodiment, may include a plurality of magnets for securing the housing to an exterior metal surface of a vehicle. The housing may also be configured for mounting along the lip of a vehicle or craft or it may be permanently secured to the exterior of the craft or vehicle.

These and other features, objects and advantages of the present invention will become more apparent from the detailed description set forth below when taken in conjunction with the drawings in which like reference numerals identify like elements throughout.

BRIEF DESCRIPTION OF THE DRAWINGS

In the course of the following detailed description, reference will be frequently made to the accompanying drawings in which.

DETAILED DESCRIPTION OF THE DRAWINGS

Figure 1:
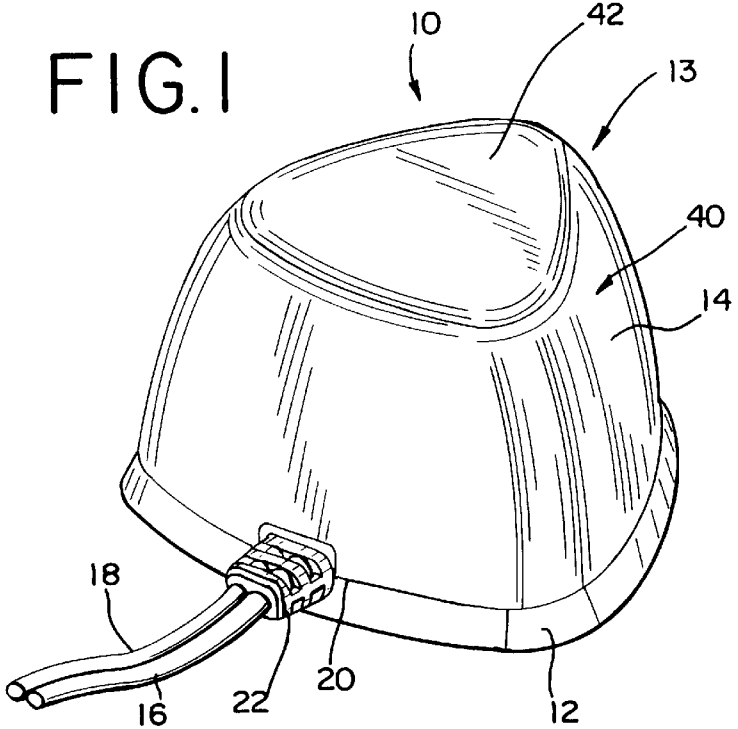
FIG. 1 is a perspective view of a first embodiment of a multi-purpose antenna constructed in accordance with the principles of the present invention.

Referring now to FIG. 1, a multi-purpose antenna constructed in accordance with the principles of the present invention is generally designated at 10. The multi-band antenna 10 is a low-profile multiple-use system that permits wireless transmission and reception of RF signals throughout the cellular and GPS frequency bands. As will be understood to follow, the antenna is particularly useful with vehicles and has significant utility with respect to automobiles, watercraft, farm equipment and the like. The antenna 10 permits the user to couple both a cellular transceiver and a GPS positioning receiver thereto that permits the user to determine the location of the vehicle or craft.

The antenna 10 includes a housing 13 for the antenna 10 formed from a base portion 12 and a cover portion 14 that protect the antenna components from the outside environment. The antenna 10 is fed by two coaxial feed lines 16, 18 that lead to transceivers and/or receivers mounted in a passenger compartment of a vehicle, which preferably have a characteristic impedance of 50 ohms and preferably include RG174 cables. The two feedlines 16, 18 are routed into the housing 13 through a feed port 20 formed in the housing cover portion 14. A strain relief 22 may be applied to the feedlines 16, 18 outside the feed port 20 to hold the two feedlines 16, 18 together where they enter the housing 13.

Figure 2:
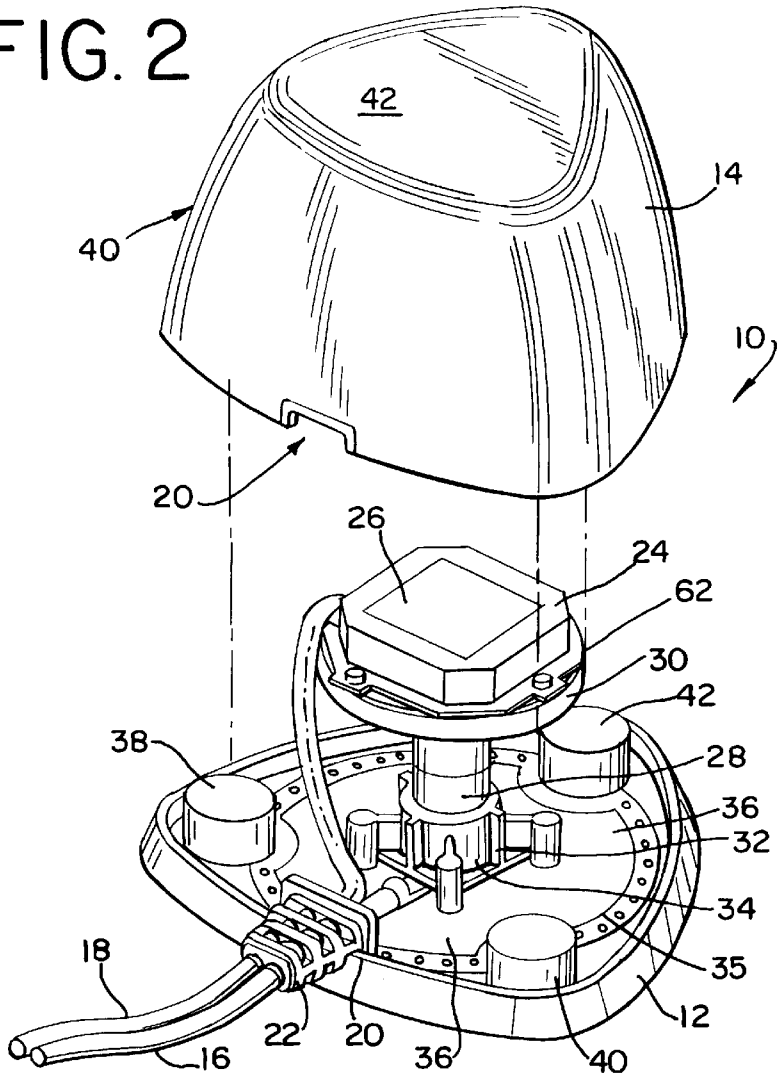
FIG. 2 is the same view as FIG. 1, but with the housing cover portion removed for clarity.

FIG. 2 illustrates the antenna 10 with the housing cover portion 14 removed to show a global positioning system (GPS) low noise amplifier unit 24 that includes, along with its conventional GPS electronic circuitry 25, a GPS patch radiating element 26 positioned on the top of the unit 24. The GPS amplifier unit 24 is preferably disposed above and supported by a continuous cellular radiating element 28 by way of mechanical fasteners or other suitable means. The cellular radiating element 28 illustrated has the form of a hollow, upright horn member 27 having a cylindrical base 29 with an upper flared, or tapered portion 30 that accommodates and supports the GPS amplifier unit 24.

As stated above, two feedlines, 16 and 18 are provided for feeding the two radiating elements 26, 28 and for coupling them to transceivers/receivers of the vehicle or craft which are typically disposed within the passenger compartments thereof.

One of the two feed lines 18 provides electrical communication between the GPS unit, particularly the GPS radiating element 26, and the GPS receiver, while the other feed line 16 provides electrical communication between the cellular radiating element 28 and the cellular transceiver.

Figure 5:
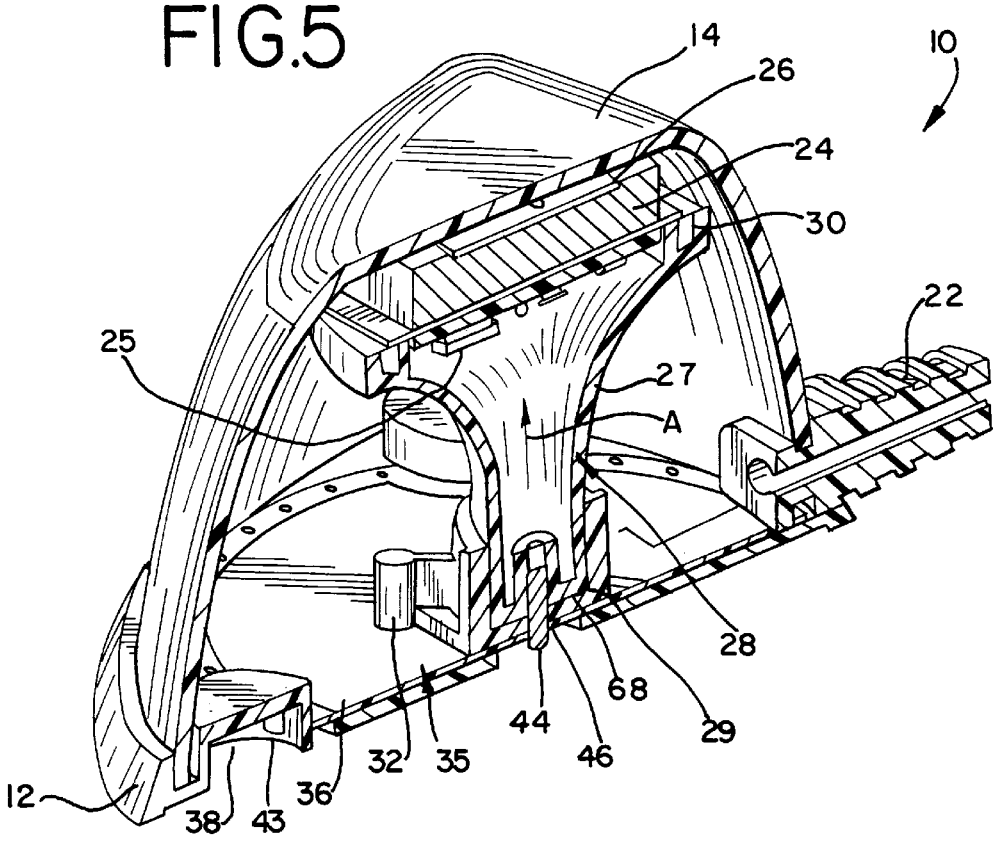
FIG. 5 is an oblique sectional view taken along line 5—5 of FIG. 4 with the two antenna feedlines removed for clarity.

Focusing specifically on the cellular radiating element 28, and as best shown in FIG. 5, it can be seen that the element 28 is supported at an angle to a groundplane 35, shown in the form of a planar printed circuit board 36, by way of a dielectric radiator support 32. The radiator support 32 is illustrated as a hollow tubular member 34 that receives the base portion 29 of the cellular radiator 28. The radiator support 32 is positioned on the groundplane member 35 that, as explained in detail below, assists in establishing the signal connection between the cellular feed line 16 and its associated radiating element 28 and also establishes a groundplane 35 for the antenna 10.

Figure 3:
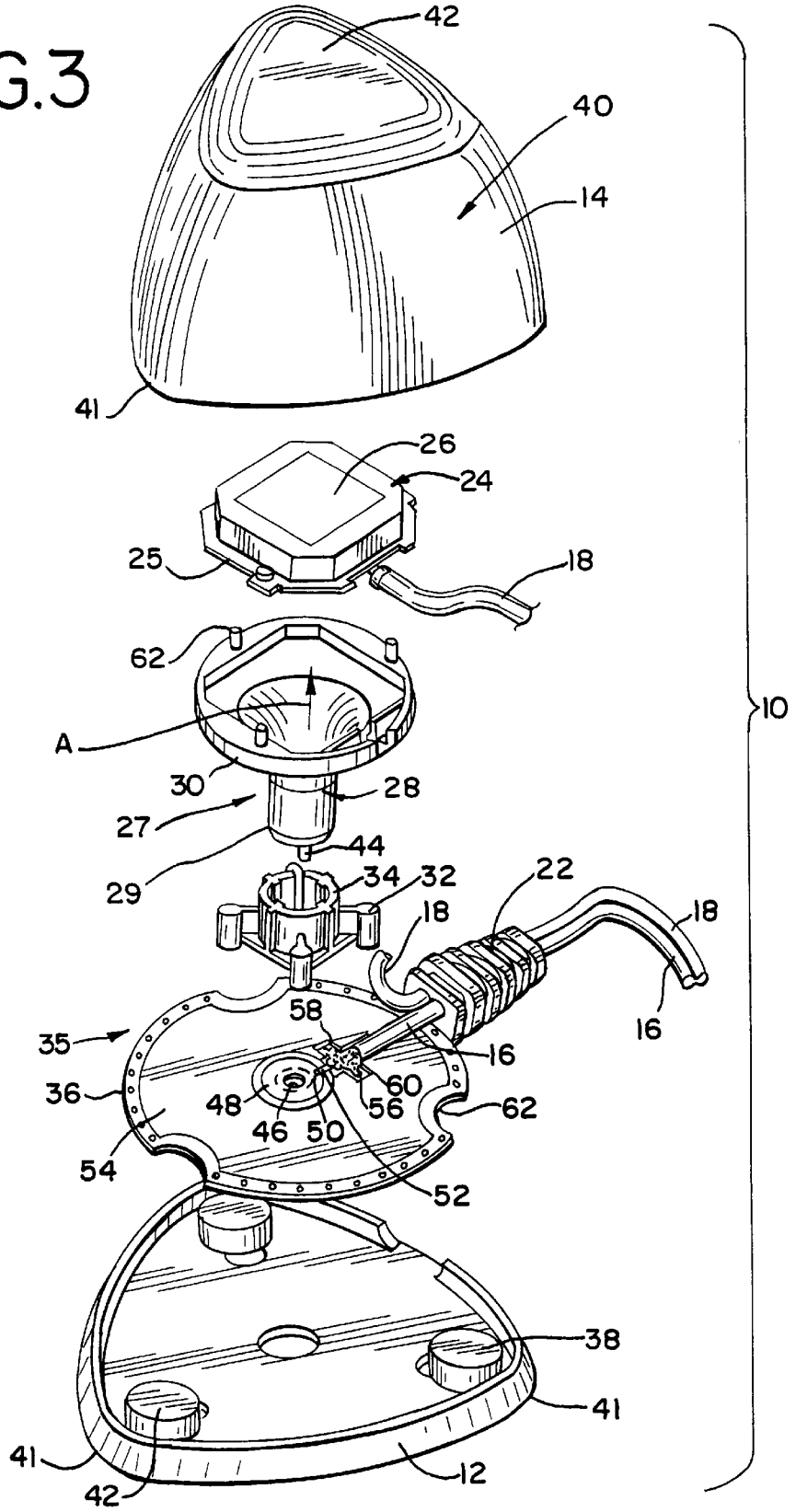
FIG. 3 is an exploded view of the antenna of FIG. 1.

Referring now to FIG. 3, the cellular radiating element 28 is provided with a conductive pin 44 that connects to the groundplane circuit board 36, preferably by fitting into a center opening 46 thereof. The conductive pin 44 extends from the base portion 29 of the cellular radiator 28. The pin 44 may be formed integrally with the cellular radiator 28 or as illustrated, may be formed separately and received within a recess 68 formed in the radiator base portion 29. The connecting pin 44 establishes a signal and circuit path between the cellular radiator 28 and an associated transceiver (not shown) in the vehicle or craft by way of a connection to the center conductor 50 of cellular coaxial feedline 16. The feedline 16 thereby feeds the cellular radiating element 28 at its center at the level of the ground plane 35.

Figure 3A:
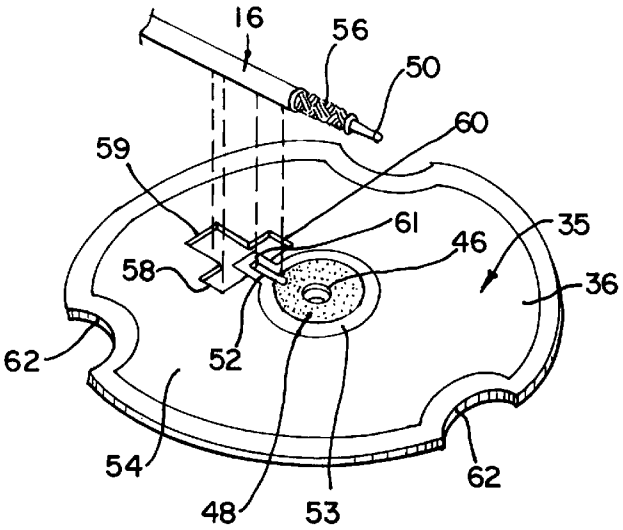
FIG. 3A is an enlarged detail view of FIG. 3 illustrating the cellular feed cable-ground plane interface.

The opening 46 of the groundplane circuit board 36 is surrounded by and in electrical communication with an inner circular conductive layer 48 deposited on the surface of the circuit board 36. (FIG. 3A). The center conductive layer 48 includes a bonding pad 52 that extends therefrom to which a center conductor 50 of the cellular coaxial cable feedline 16 is soldered. The bonding pad 52 electrically communicates with the inner conductive layer 48 and thereby provides a signal path between cellular radiator 28 and an associated transceiver in the passenger compartment of the vehicle or craft.

The ground plane circuit board 34 further includes an outer conductive layer 54 that is concentric with the inner conductive layer 48 and serves as the ground plane for both the cellular radiator 28 and the GPS patch radiator 26 of the antenna 10. The two conductive layers 48, 54 are separated by an intervening insulative, intervening ring 53 of the circuit board 36 that has its conductive coating removed to electrically separate the two conductive layers 48, 54. As shown best in FIG. 3A, the outer ground conductor 56, illustrated as a conventional woven wire braid that encircles the insulative covering of the center conductor 50, is soldered to three bonding pads 58–60 that abut edges of a slot 61 that communicates with the insulative separator ring 53. This establishes an electrical connection between the outer, ground conductor 56 of the feedline 16. The bonding pads 58–60 electrically connect with the outer concentric conductive layer 54 to thereby establish a ground plane for antenna 10.

Referring now to FIG. 5, the GPS amplifier unit 24 is stacked atop the cellular radiating element 28 and is mounted thereto by mechanical fasteners, such as the hollow rivet tubes 62 that may be formed as part of the upper flared portion 30 of the cellular radiator 28. In this stacked orientation, the GPS amplifier unit 24 has a top loading effect on cellular radiator 28 to effectively broaden the bandwidth of the cellular radiator and permit it to operate in all of the pertinent cellular frequency bands (NAMPS, GSM, PCS, PCN, JTACS, etc.).

The GPS feedline 18 enters the housing 13 through its port and rises up as shown in FIG. 2 to feed the GPS amplifier unit 24 from an edge thereof and exterior of the cellular radiating element 28. Importantly, the cellular radiating element 28 has a varying diameter along its vertical longitudinal axis A with the outer diameter of the radiator increasing with the height of the radiator 28 above the groundplane 35. Preferred results have been obtained with radiators that have an increase in diameter of about 400% between the top and bottom of the radiating element 28, when the base portion 29 is about 0.375 inches (1 cm) and the upper flared portion 30 is about 1.50 inches (3.8 cm). The circular cross-section of the cellular radiating element 28 provides a good support structure for the GPS unit 24 and the positioning of the GPS unit 24 above the flared portion provides a combined top loading effect on the cellular radiator, which, as already described, broadens its bandwidth to permit its operation in all cellular frequency bands. This stacked orientation is further beneficial since the cellular radiating element 28 is vertically polarized and has an omni-directional radiation pattern, while the GPS radiating element is right hand circular polarized and has a vertically directional radiation pattern, thereby permitting isolation of the received and transmitted cellular and GPS RF signals.

In order to facilitate the mounting of the housing 13 onto a metal surface of a vehicle or craft, the housing base portion 12 preferably includes receptacles 38, with three such receptacles being illustrated, that accommodate magnets 43 therein in a manner such that faces of the magnets are exposed to contact an opposing surface. A preferred magnet for use in the receptacles 38 is a neodymium-boron magnets that provide superb attachment and holding power. The groundplane circuit board 36 may include cutout portions 62 which accommodate the magnet receptacles 38 so as not to interfere with placement of the groundplane circuit board 36 onto the housing base portion 12.

Figure 4:
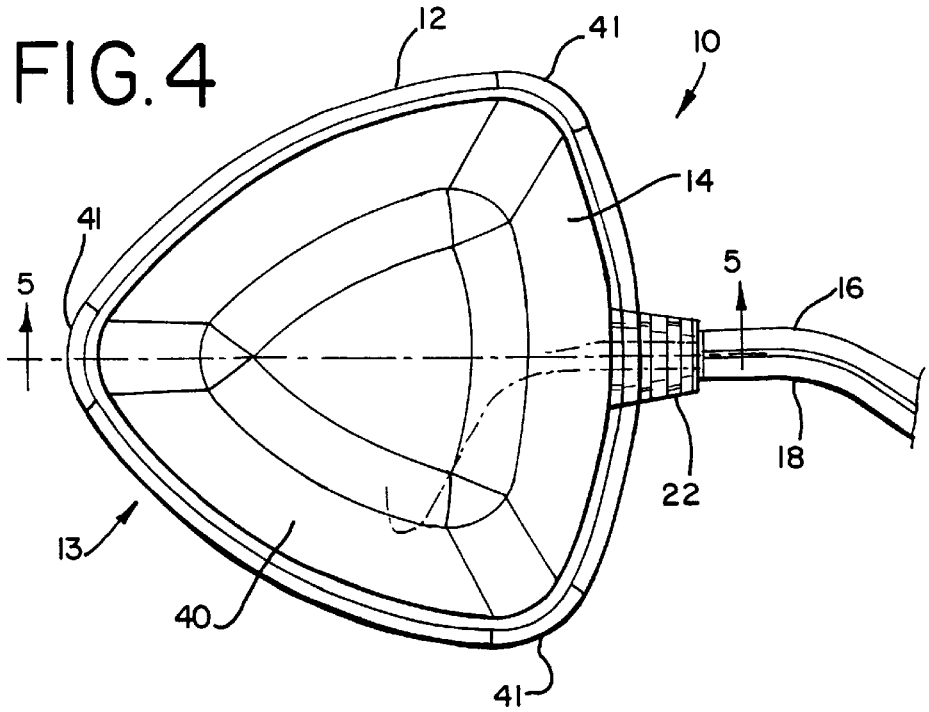
FIG. 4 is a top plan view of the antenna of FIG. 1, illustrating in phantom the path of the leads from the feed cables.

In a unique aspect of the present invention, the housing 13, and particularly the cover portion 14 thereof, has an overall polygonal configuration that is shown best in FIG. 4 as what may be aptly described as a truncated, triangular prism 40 that extends up from the triangular-shaped housing base portion 12. In this regard, the receptacles 38 and magnets 43 therein are preferably disposed at the apexes 41 of the polygon, with the housing 13 illustrated as having three apexes. The truncated portion of the housing 13 has a substantially planar surface 42 that opposes the GPS patch radiator 26 located atop the GPS unit 24 and is preferably spaced apart therefrom.

The cellular radiating element 28 provides a omni-directional radiation pattern that extends 360° radially away from the antenna 10 in a horizontal plane, while the GPS patch radiating element 26 provides a directional radiation pattern that extends vertically away from the antenna 10. It has been found that the positioning the GPS antenna unit 24 in a stacked orientation above the cellular radiating element 28, in combination with the upper flared portion of the cellular radiator effectively isolates the GPS radiation pattern from the cellular radiation pattern. Moreover, stacking the GPS amplifier unit 24 above the cellular radiating element 29 provides beneficial top loading to the cellular radiating element 28 which increases its operating bandwidth so that it may operate in all cellular frequency bands.

Figure 6:
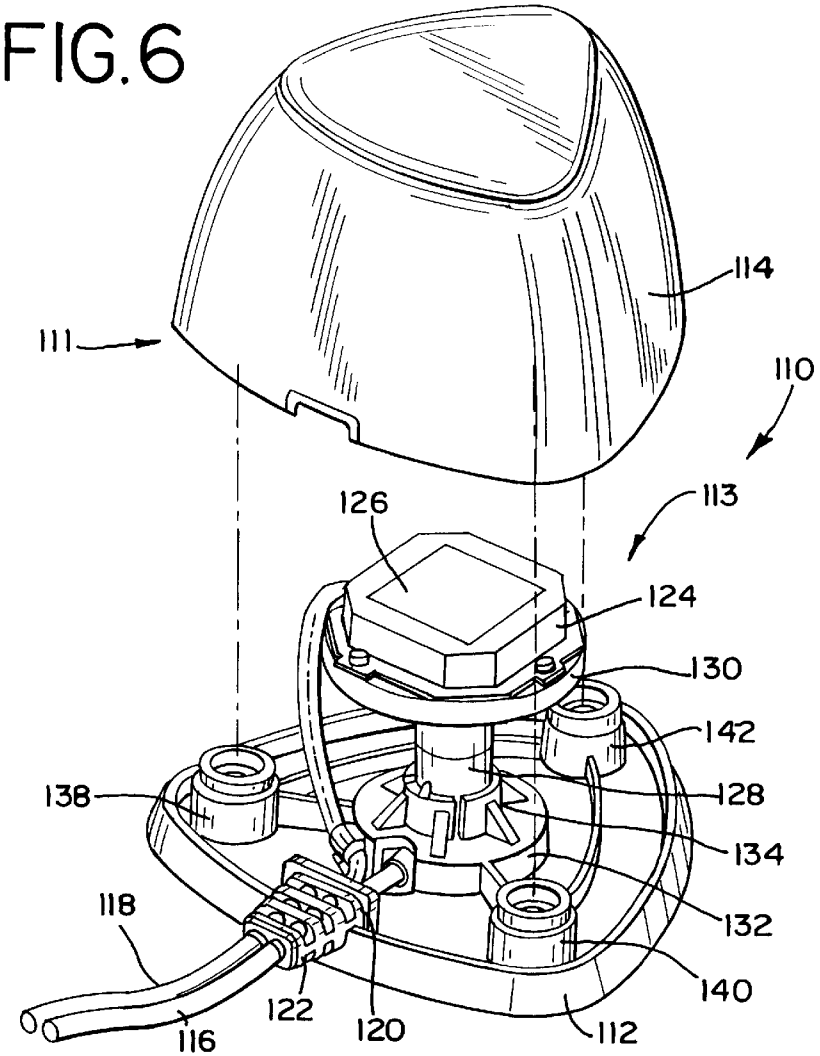
FIG. 6 is a perspective view of a second embodiment of a multi-purpose antenna constructed in accordance with the principles of the present invention illustrated with the housing cover portion removed for clarity.

Referring now to FIG. 6, a second embodiment of the multi-purpose antenna of the present invention is generally designated as 110. The multi-purpose antenna 110 is a low-profile system that permits wireless transmission and reception of RF signals throughout the cellular and GPS frequency bands. The antenna 110 includes a housing 111 having base 112 and a cover 114 that interengage to form a hollow enclosure 113 that protects the antenna components from the outside environment. Antenna 110 is also fed by two coaxial cable feedlines 116, 118, preferably having characteristic impedances of 50 ohms, and preferably RG174 cables. The feedlines 116, 118 are routed through a port 120 and protected by a strain relief 122 that is preferably positioned just outside the feed port.

Figure 8:
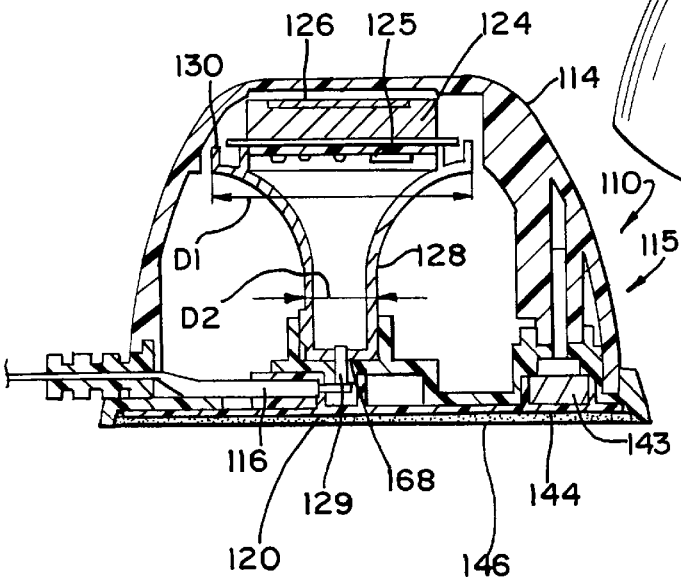
FIG. 8 is a sectional view taken along line 8—8 of FIG. 7.

The antenna 110 further includes a global positioning system low noise amplifier unit 124. The GPS amplifier unit 124 includes, conventional GPS electronic circuitry 125 and supports a GPS patch radiator 126. The GPS amplifier unit 124 rests upon and is supported by a cellular radiating element 128. This hollow cellular radiating element 128 also includes an upper flared portion 130 that supports the GPS amplifier unit 124. The flared portion 130 has a diameter $D_1$ that is greater than the diameter $D_2$ (FIG. 8) of the base portion 129 of the radiating element 128 so that the overall diameter of the radiating element 128 may be considered as varying along the height of the cellular radiating element.

Figure 7:
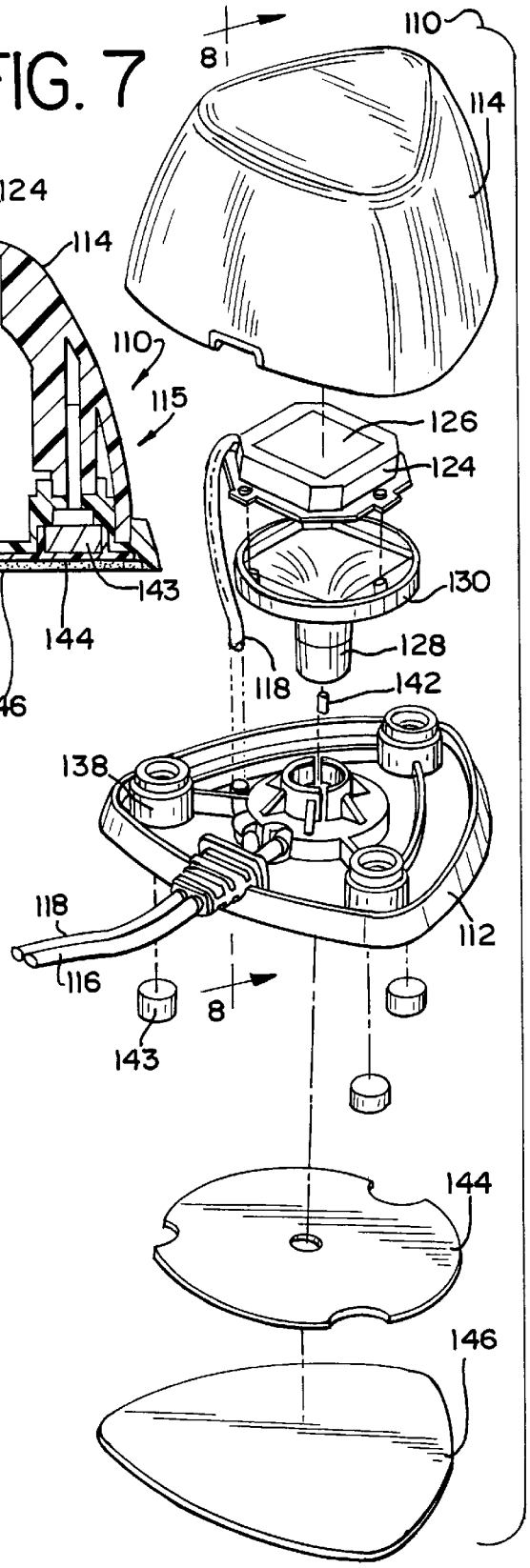
FIG. 7 is an exploded view of the antenna of FIG. 6.
Figure 9:
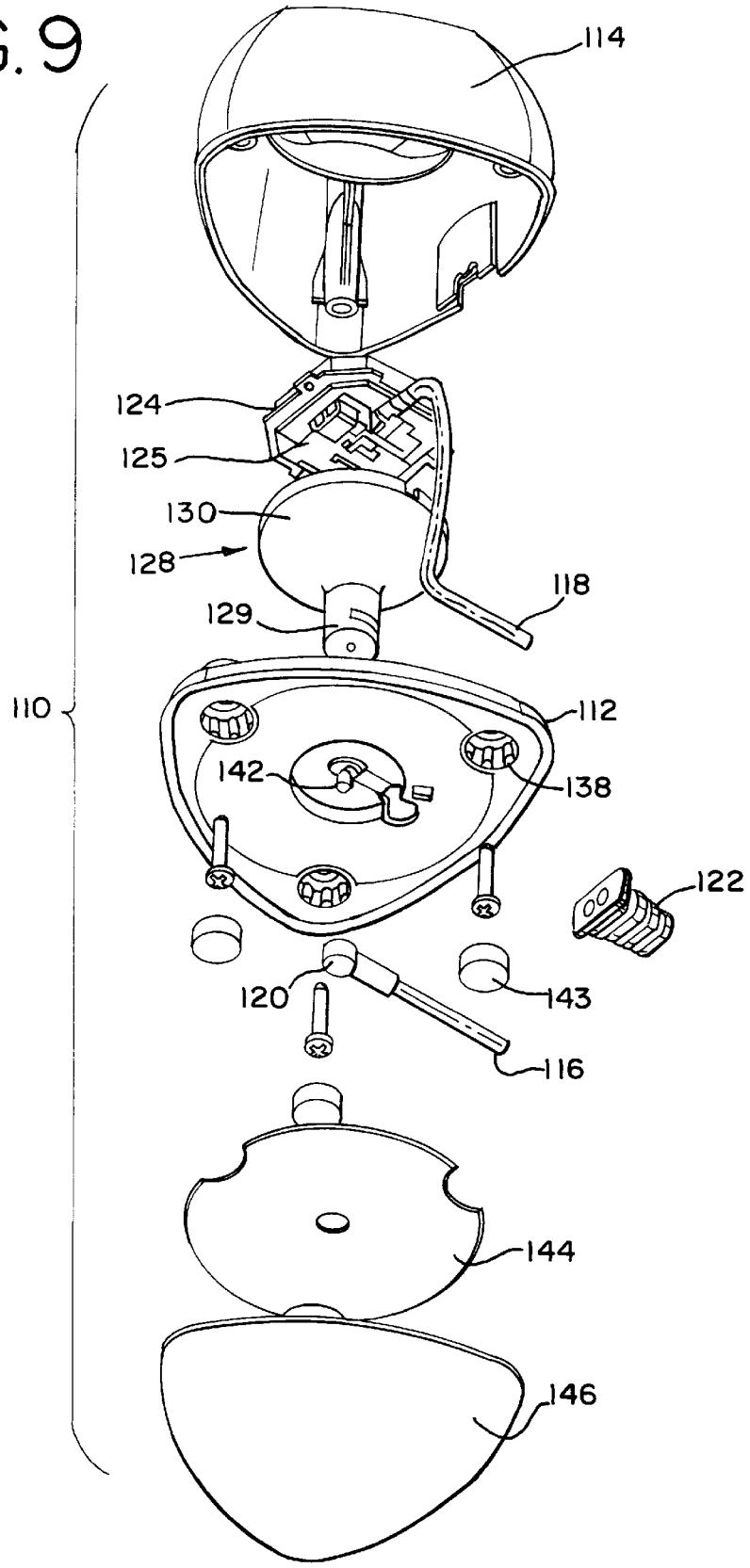
FIG. 9 is an exploded perspective view of the antenna of FIG. 7 taken from underneath the antenna.

As shown in FIG. 7, coaxial cable feedline 118 electrically communicates with the GPS amplifier unit 124. The feedline 118 extends up into contact with the amplifier unit 124 and connects it to a GPS receiver unit (not shown) in the vehicle or craft. A radiator support 132 is included to support the cellular radiating element 128 within the housing 113 on the base portion 112 thereof. Radiator support 132 includes a central hollow tubular piece 134 to accommodate the base portion 129 of the cellular radiating element 128. The cellular radiating element 128 also includes a conductive pin 112 that is press-fitted into a centerpoint contact at the center of base 112. A conventional right angle cable assembly 120 connects the center conductor of feedline 116 with the conductive pin 142 of cellular radiating element 128. This provides a signal path between cellular radiating element 128 and its associated transceiver (not shown). This right angle assembly 120 permits the center feed connection to be effected with the cellular radiating element 128 from underneath the housing base portion 112.

A groundplane in the form of a conductive plate 144 is included as part of antenna 110. The coaxial cable right angle assembly is soldered to the groundplane plate 144 to establish a groundplane for the antenna 110. A vinyl pad 146 is preferably further included to help seal the electrical contacts of antenna 110 from environmental exposure.

The housing base portion 112 may have formed therein, a series of receptacles 138 that receive associated mounting magnets 143, preferably neodymium-baron magnets for attaching the antenna 110 to an exposed metal surface of a vehicle or craft. It will be understood that although the present housing of the invention has been described only in terms of magnetic mounting, other mounting applications may be used, such as a window mount or the like.

Figure 10:
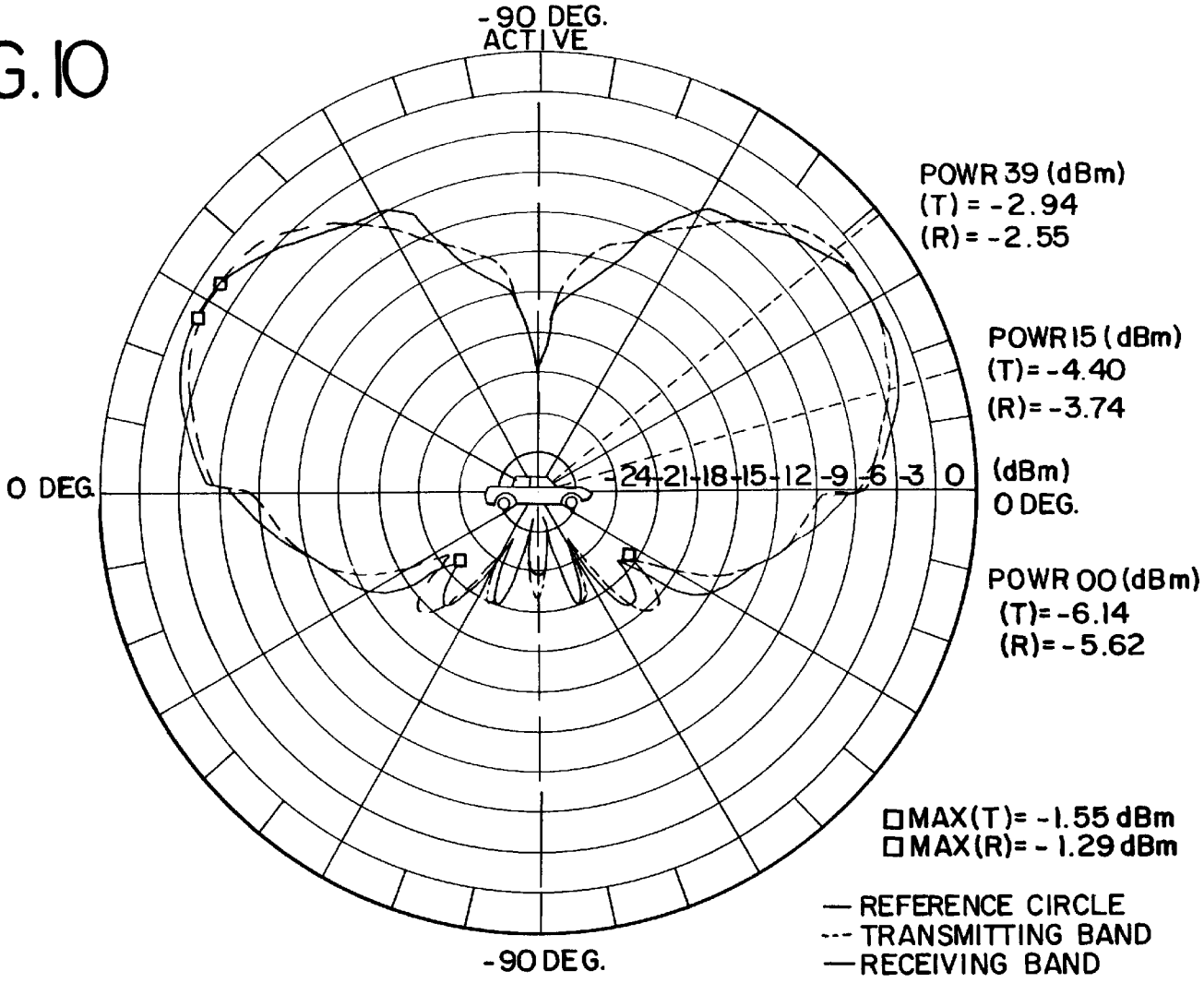
FIG. 10 is a radiated power plot taken in an elevation plane of the cellular radiating element of the antenna of FIG. 1; and, FIG. 11 is a radiated power plot taken in an elevation plane of the GPS radiating element of the antenna of FIG. 1.
Figure 11:
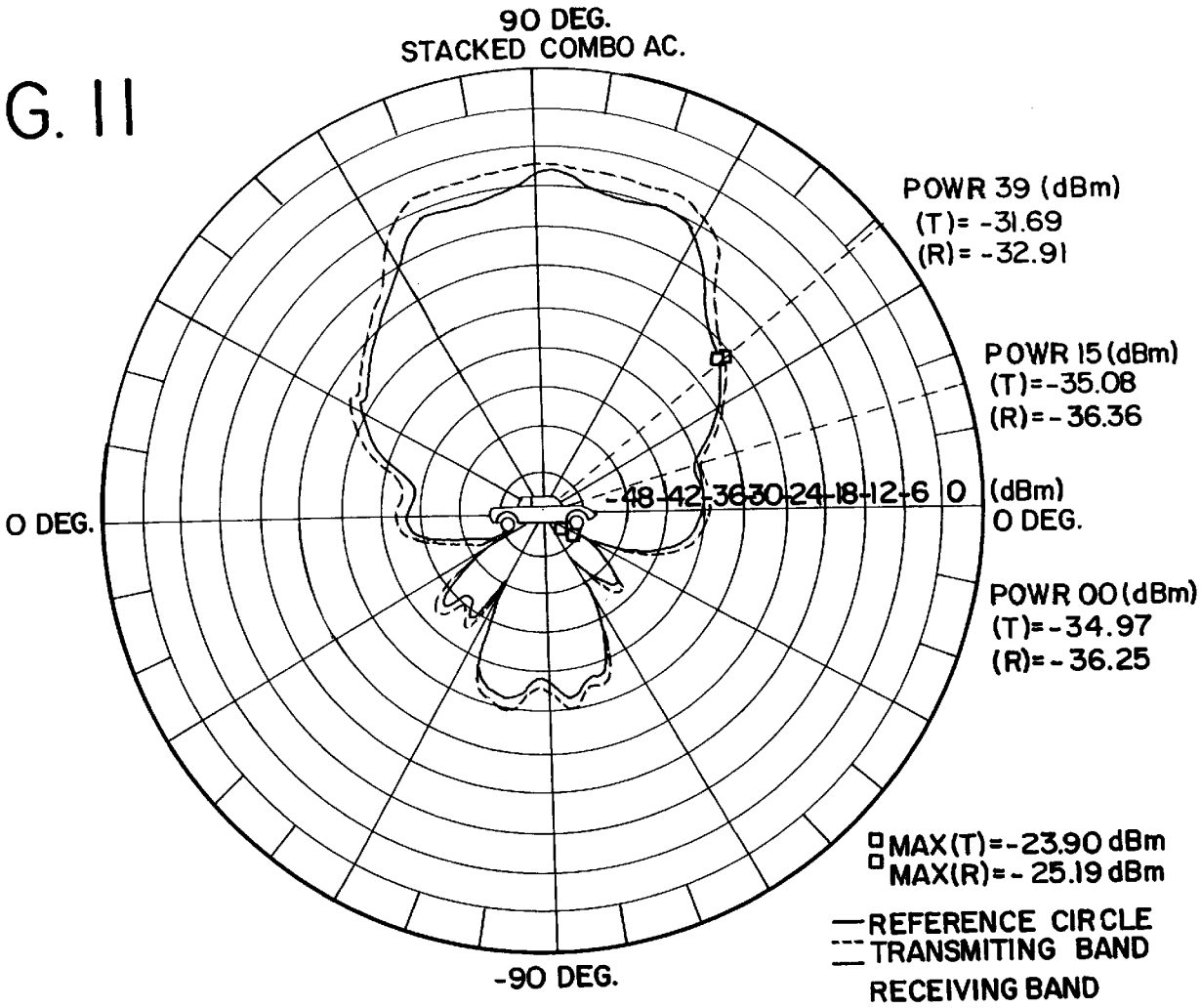

FIGS. 10 and 11 are plots of the radiated power in the elevation (vertical) plane for the cellular radiating element of and the GPS radiating element, respectively. As seen in those Figures, the cellular radiating element has an omni-directional radiation pattern, while the GPS patch radiating element has a directional radiation pattern extending vertically upward.

Although the present invention has been described by reference to certain preferred embodiments, it should be understood that those preferred embodiments are merely illustrative of the principles of the present invention. Accordingly, changes and/or modifications may be made by those skilled in the art without departing from the true spirit and scope of the invention as defined by the appended claims.

What is claimed is:

1. A multi-purpose antenna for operation in at least two different wireless bands, comprising: a cellular antenna unit, a global positioning satellite (GPS) antenna unit, and a conductive groundplane, the cellular antenna unit including a radiating element extending upright at an angle to the groundplane, the cellular radiating element having opposing first and second ends that are interconnected by a body portion, the body portion having an outer diameter that varies between said first and second ends of said cellular radiating element, said cellular radiating element having a base portion proximate said first end thereof, said cellular radiating element to a cellular transceiver, said cellular radiating element second end defining a support portion that is spaced apart from and above said groundplane, said GPS antenna unit including a GPS radiating element that is supported above said cellular radiating element at said cellular radiating element second end, a first coaxial feedline for connecting said cellular radiating element to a cellular transceiver for feeding said cellular radiating element, a second coaxial feedline for connecting said GPS antenna unit to a GPS receiver and for feeding said GPS antenna unit, said first feedline feeding said cellular radiating element at about the center of said cellular radiating element first end and said second feedline feeding said GPS antenna unit at a point above and exterior of said cellular radiating element.

2. The multi-purpose antenna defined in claim 1, wherein said cellular radiating element is a quarter-wave radiating element.

3. The multi-purpose antenna as defined in claim 1, wherein said GPS antenna unit includes a low noise amplifier and a GPS radiating element disposed atop said low noise amplifier.

4. The multi-purpose antenna as defined in claim 3, wherein said GPS radiating element is a patch radiator.

5. The multi-purpose antenna as defined in claim 1, wherein said cellular radiating element includes a continuous, hollow, conductive vertical tube.

6. The multi-purpose antenna as defined in claim 1, further including a housing enclosing said cellular and GPS antenna units in a single, interior space, the housing having a configuration that approximates a truncated prism.

7. The multi-purpose antenna as defined by claim 6, wherein said truncated prism is a truncated triangular prism.

8. The multi-purpose as defined by claim 6, wherein said housing has interengaging cover and base portions, the base portion has a polygonal configuration with at least tree apexes, said housing including at least three mounting magnets disposed on said base portion proximate to said base portion apexes for magnetically attaching said housing to a metal surface.

9. The multi-purpose antenna as defined in claim 1, further including a dielectric spacer element interspersed between said groundplane and said cellular radiating element, said dielectric spacer supporting said radiating element at said angle to said groundplane.

10. The multi-purpose antenna as defined by claim 1, wherein said cellular radiating element operates between 806 megahertz (MHz) and 1990 megahertz (MHz).

11. The multi-purpose antenna as defined by claim 1 wherein said cellular radiating element is operable within either a PCS or PCN frequency band.

12. The multi-purpose antenna as defined in claim 1, wherein said GPS antenna unit operates within either an L or L1 band.

13. The multi-purpose antenna as defined in claim 1, further including a housing for enclosing said cellular and GPS antenna units to protect them from the environment, the housing having interengaging cover and base portions.

14. The multi-purpose antenna as defined in claim 13, further indicating a spacer element for supporting said cellular radiating element upon said groundplane.

15. The multi-purpose antenna as defined in claim 14, wherein said spacer element is integrally formed with said housing base portion and said housing base portion includes a recess that receives said groundplane and said housing base portion is interposed between said cellular radiating element and said groundplane.

16. A multi-band, multi-purpose antenna for transmitting and receiving both voice signals and data signals, comprising:

a planar groundplane; a cellular antenna element disposed at a predetermined angle to said groundplane; a global positioning antenna element supported by said cellular antenna above said cellular antenna element and said groundplane; said cellular antenna element including a quarter-wavelength cellular radiator having first and second opposing ends, said cellular radiator first end including a base portion disposed in opposition to said groundplane and electrically connected to a first conductive area of said groundplane; a dielectric spacer member that engages said cellular radiator first end and supports said cellular radiator above said groundplane; said cellular radiator second end including a flared portion having a diameter greater than a diameter of said cellular radiator first end; said global positioning antenna element including a low noise amplifier element and a patch radiator disposed above said low noise amplifier, whereby said global positioning antenna element provides top loading for said cellular antenna element.

17. The antenna of claim 16, wherein said cellular radiator includes a hollow, conductive, horn-shaped element.

18. The antenna of claim 16, further including a base portion and a cover portion, the base and cover portions being matable together to form a protective housing that enclose said cellular and global positioning antenna elements.

19. The antenna of claim 18, wherein said base portion is formed from a dielectric material and said spacer member is integrally formed with said base portion.

20. The antenna of claim 16, further including a first feedline for connecting said cellular antenna element with a transceiver and a second feedline for connecting said global positioning antenna element with a transceiver, said first feedline feeding said cellular antenna element at a center point of said cellular radiator.

21. The antenna of claim 20, wherein said groundplane includes first and second conductive areas disposed thereon that are separated by an intervening non-conductive area, and said first feedline includes first and second conductors, said first feedline first conductor being in electrical communication with said cellular radiator and said groundplane first conductive area, said first feedline second conductor being in electrical communication with said groundplane second conductive area.

22. The antenna of claim 20, wherein said second feedline feeds said global positioning antenna element from exterior of said cellular antenna element.

23. A multi-band antenna for mobile wireless voice/data communication and global positioning comprising:

a housing that includes a base extending substantially in a plane and a cover that engages said base, said base including at least one means for mounting said antenna to a surface;

a quarter-wavelength cellular radiator extending in a direction generally transverse to said plane of said base, said cellular radiator including an upper flared portion and a lower feed portion having a conductive pin that allows said cellular radiator to be electrically connected with a transceiver; and, a global positioning system low noise amplifier supported by said upper flared portion of said cellular radiator, said low noise amplifier including a feed point spaced apart from and exterior of said cellular radiator that allows said low noise amplifier to be electrically connected with a global positioning system.

* * * * *